US009103130B2

(12) United States Patent
Calvo Echeveste et al.

(10) Patent No.: US 9,103,130 B2
(45) Date of Patent: Aug. 11, 2015

(54) FORMWORK SUPPORT BEAM

(75) Inventors: Ibon Calvo Echeveste, Aretxabaleta (ES); Jon Iñaki Leceta Lasa, Bergara (ES); Aitor Fabian Mariezcurrena, Ridgewood, NJ (US); Alexander Ruiz De Azua Vaquero, Vitoria/Gasteiz (ES); Fernando Cortes Martinez, Bilbao (ES)

(73) Assignee: ULMA CyE, S. COOP., Onati (ES)

( * ) Notice: Subject to any disclaimer, the term of this patent is extended or adjusted under 35 U.S.C. 154(b) by 0 days.

(21) Appl. No.: 14/130,489

(22) PCT Filed: Jun. 28, 2012

(86) PCT No.: PCT/EP2012/062617

§ 371 (c)(1),
(2), (4) Date: Dec. 31, 2013

(87) PCT Pub. No.: WO2013/004594

PCT Pub. Date: Jan. 10, 2013

(65) Prior Publication Data

US 2014/0145062 A1 May 29, 2014

(30) Foreign Application Priority Data

Jul. 1, 2011 (ES) ..... 201131127

(51) Int. Cl.

| | |
|---|---|
| ***E04G 11/50*** | (2006.01) |
| ***E04C 3/29*** | (2006.01) |
| *E04C 3/04* | (2006.01) |

(52) U.S. Cl.

CPC . *E04G 11/50* (2013.01); *E04C 3/29* (2013.01); *E04C 3/291* (2013.01); *E04C 2003/0413* (2013.01); *E04C 2003/0421* (2013.01); *E04C 2003/0439* (2013.01); *E04C 2003/0452* (2013.01)

(58) Field of Classification Search

CPC ..... E04C 3/29; E04C 3/291; E04C 3/292; E04C 2003/0421; E04C 2003/0413; E04C 2003/0439; E04C 2003/0452; E04G 11/50; E04G 17/14

USPC ..... 52/834, 837, 847, 838, 841; 249/207, 249/210

See application file for complete search history.

(56) References Cited

U.S. PATENT DOCUMENTS

| | | | |
|---|---|---|---|
| 4,580,380 | A | 4/1986 | Ballard |
| 5,678,381 | A | 10/1997 | Denadel |
| 6,519,911 | B1 | 2/2003 | Sawada |
| 7,578,110 | B2 | 8/2009 | Jenkins |
| 2004/0226254 | A1 | 11/2004 | Charlwood |

FOREIGN PATENT DOCUMENTS

| | | | |
|---|---|---|---|
| FR | 2166338 | A1 | 8/1973 |
| FR | 2418415 | A1 | 9/1979 |
| WO | WO0058582 | A1 | 10/2000 |
| WO | WO2013004594 | A1 | 1/2013 |

OTHER PUBLICATIONS

International Search Report (ISR) and Written Opinion of the International Searching Authority, International Application No. PCT/EP2012/062617, International Filing Date Jun. 28, 2012, Date of Mailing ISR Nov. 8, 2012, 11 pages, European Patent Office, Rijswijk Netherlands.

*Primary Examiner* — Michael Safavi
(74) *Attorney, Agent, or Firm* — Tim Kitchen; Peter N. Scull; Hamilton DeSanctis & Cha, LLP

(57) ABSTRACT

A formwork structural member having at least one core made of a material that has a density between approximately 40 kg/m$^3$ and approximately 500 kg/m$^3$, and at least one metal casing that substantially covers an outer contour of the core, the metal casing being arranged attached to the core.

16 Claims, 3 Drawing Sheets

FORMWORK SUPPORT BEAM

CROSS-REFERENCE TO RELATED APPLICATIONS

This application relates to and claims the benefit and priority to International Application No. PCT/EP2012/062617, filed Jun. 28, 2012, which claims the benefit and priority to Spanish Patent Application No. 201131127, filed Jul. 1, 2011.

TECHNICAL FIELD

This invention relates to a formwork structural member.

BACKGROUND

There are known structural members such as beams, used in the construction industry, in particular to support formworks. These types of structural members are subjected to significant mechanical stresses, in particular to high static charges and impacts caused by hits, collisions, etc., which affect the ends of the beams in particular.

The structural members used to support a formwork preferably have an I or double T cross-section, comprising two flanges connected to each other through a web that may be solid or a truss. These structural members are designed to support, generally, a flexural rigidity (E) between approximately 200 kN/m$^2$ and approximately 800 kN/m$^2$, a flexural resistance (M) between approximately 6 kNm and approximately 15 kNm, and a shear strength (V) between approximately 18 kN and approximately 28 kN, with an edge between approximately 160 mm and approximately 240 mm and a minimum width of the flange between approximately 65 mm and approximately 80 mm.

In addition, these types of structural members may be reused, they are not single-use. Furthermore, as they are used outside, they are subjected to adverse weather conditions. There are known structural members made of metal, preferably steel, which as well as meeting mechanical requirements are resistant to adverse meteorological conditions, but which also have very heavy beams and are thus very expensive. As a result, the material most commonly used for these types of structural members is wood, with which a beam that is low in weight is achieved and which meets mechanical requirements, although said beam is less durable, as it is a material that suffers, among other things, adverse weather conditions.

GB2106561A describes a structural member of I shape, made of wood, which comprises a web that also comprises three layers of wood arranged fixed to each other, and two flanges each one of which comprises at least three layers of wood arranged fixed to each other. The web comprises projections that extend axially from each end, which cooperate with housings arranged in each flange for their fixing.

U.S. Publication No. US2009/0249742A1 describes a beam that comprises flanges made preferably of wood, and a web made of a material other than wood, preferably metal. The web has extensions that are inserted respectively in each flange of wood. In addition, the metal web is substantially hollow, the drawback of which is that concrete may get inside it, limiting its repeated use.

Finally, U.S. Pat. No. 5,511,355 describes a construction member made of plastic with a low elasticity module and which comprises in its interior a substantially continuous lamination member with a high elasticity module. This construction member has a plane along which it has homogeneous characteristics. The lamination member falls on both sides of the plane, passing through it at least one point. The cross-sections of the lamination member and the plastic member are inversely proportional functions of the effective elasticity module of the plastic and the lamination member, with the result that the flexural rigidity of the cross-sections is essentially equal.

SUMMARY OF THE DISCLOSURE

The formwork structural member comprises a web and at least one flange that also includes at least one core of material that has a density between approximately 40 kg/m$^3$, and approximately 500 kg/m$^3$, and at least one metal casing adapted to cover substantially the free outer contour of the core, the metal casing being arranged attached to the core.

There is obtained as a result a formwork structural member that as well as meeting the mechanical requirements demanded of this type of formwork structural member, which are set out in the respective standards, has a weight optimised for its application as a formwork support, improved mechanical properties and better behaviour in the event of it receiving impacts than that offered by conventional formwork structural members mainly made of wood.

In addition, the formwork structural member offers increased durability, as the metal casing ensures the formwork structural member behaves well in conditions of use and storage in the event that it may receive impacts etc, and in particular in the weather conditions to which the structural member is subjected during its lifetime. In addition, the formwork structural member obtained can be repaired in a simple manner, increasing its durability.

Furthermore, the formwork structural member obtained may be used to support any type of formwork, it being interchangeable with current formwork structural members that are used as formwork supports.

These and other advantages and characteristics will be made evident in the light of the drawings and the detailed description thereof.

DETAILED DESCRIPTION

The formwork structural member 1;2;3;5 shown in FIGS. 1 to 5, according to the invention, meets the mechanical requirements demanded of formwork support beams.

Figure 1:
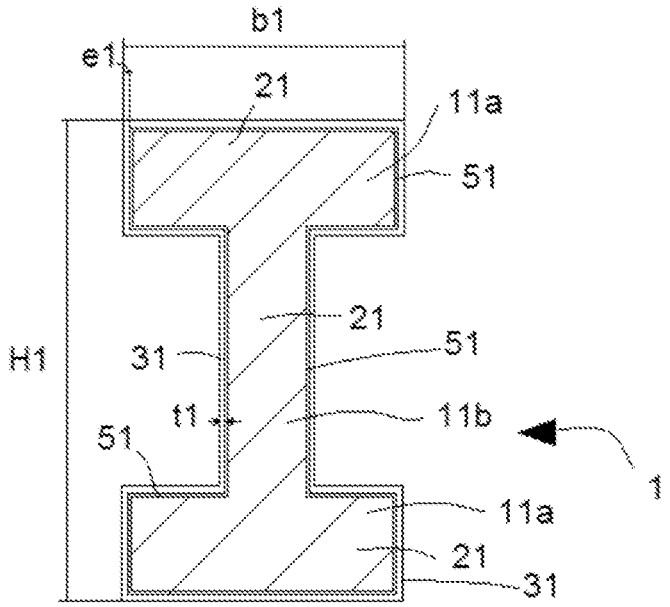
FIG. 1 shows a cross-section of a first embodiment of a formwork structural member.
Figure 2:
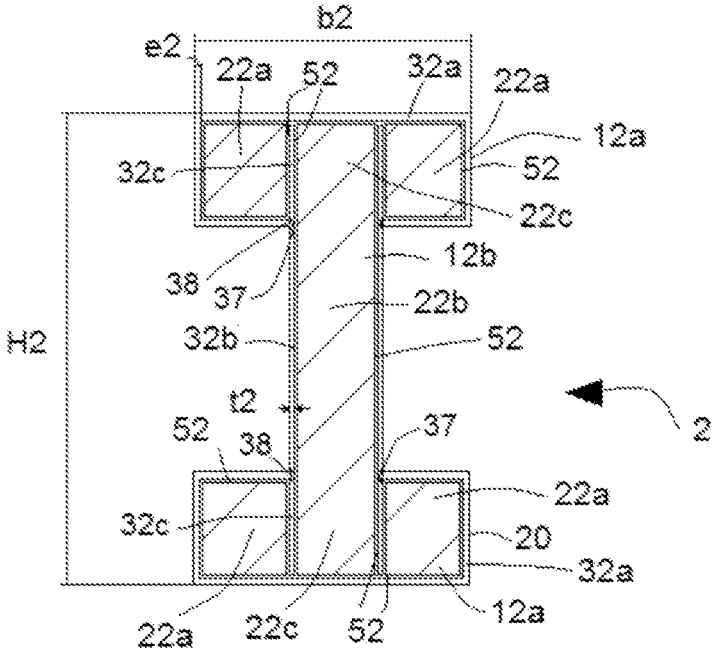
FIG. 2 shows a cross-section of a second embodiment of a formwork structural member.
Figure 4:
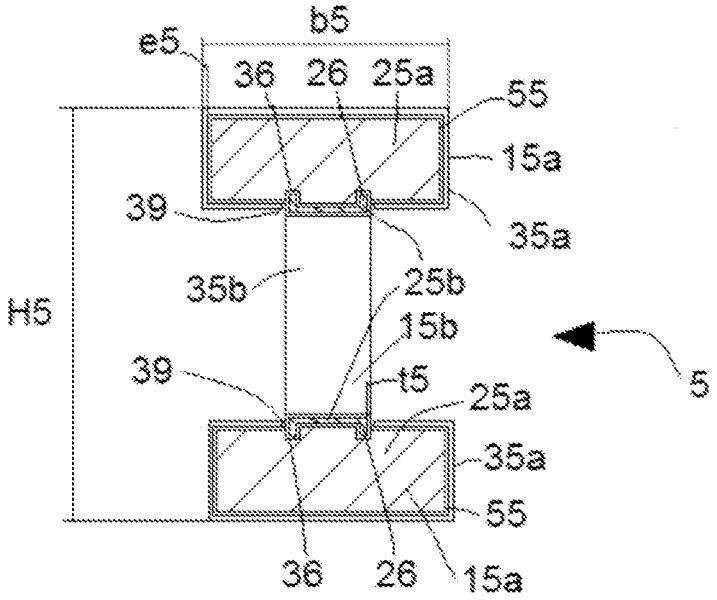
FIG. 4 shows a cross-section of a fourth embodiment of a formwork structural member.

In the embodiments shown in FIGS. 1,2 and 4, the formwork structural member 1;2;5 has a section substantially or an I or double T shape, comprising a web 11*b*;12*b*;15*b* and two flanges 11*a*;12*a*;15*a* each one of which extends continuously from an end of the corresponding web 11*b*;12*b*;15*b*. The mechanical and dimensional requirements of these formwork structural members are set out in the EN13377:2002 standard. The formwork structural member 1;2;5 is thus defined by a height H1;H2;H5 that is between approximately 160 mm and approximately 240 mm, and a width b1;b2;b5 of the respective flange 11*a*;12*a*;15*a* between approximately 65 mm and approximately 80 mm. In addition, the formwork structural member 1;2;5 supports, depending on the height dimension H1;H2;H5 and the width b1;b2;b5 of the respective flange 11*a*;12*a*;15*a*, a flexural rigidity E between approximately 200 kN/m$^2$ and approximately 800 kN/m$^2$, a flexural resistance M between approximately 6 kNm and approximately 15 kNm, and a shear strength V between approximately 18 kN and approximately 28 kN.

FIG. 1 shows an embodiment of a formwork structural member 1. The formwork structural member 1 comprises a core 21 that extends continuously in the flanges 11*a* and the web 11*b*, and a metal casing 31 that covers the free outer contour of the core 21, the casing 31 having a cross-section substantially of I or double T shape. Both the web 11*b* and the flanges 11*a* are solid.

FIG. 2 shows a second embodiment wherein the web 12*b* of the formwork structural member 2 is a solid web that comprises a first core 22*b* with a substantially rectangular section and a first casing 32*b* with a substantially rectangular cross section, which covers the outer free contour of the first core 22. In addition, each flange 12*a* comprises second cores 22*a* with a substantially rectangular section and a second casing 32*a* that covers the outer free contour of the second cores 22*a* comprised in each flange 12*a*. In this second embodiment, the first core 22*b* and the first casing 32*b* extend substantially to the end of the corresponding flange 12*a*, the respective extension 22*c* of the first core 22*b* being arranged between the second cores 22*a*, the second casing 32*a* covering the outer free contour of the second cores 22*a* and the extension 22*c* arranged adjacent to each other.

Furthermore, the first casing 32*b* comprises in each end notches 37, arranged on opposite faces of said first casing 32*b* and substantially parallel to each other. Each notch 37 extends substantially transversally to the first casing 32*b*. In addition, each second casing 32*a* has a profile with a substantially C-shaped cross-section delimited by two ends 38, with the result that each notch 37 is adapted to cooperate with one of the ends 38 of the second casing 32*a* for the elastic fixing of each second casing 32*a* to the first casing 32*b*. In other embodiments, the second casings 32*a* may be fixed to the first casing 32*b* by means of adhesives or any other type of mechanical fixing.

Figure 5:
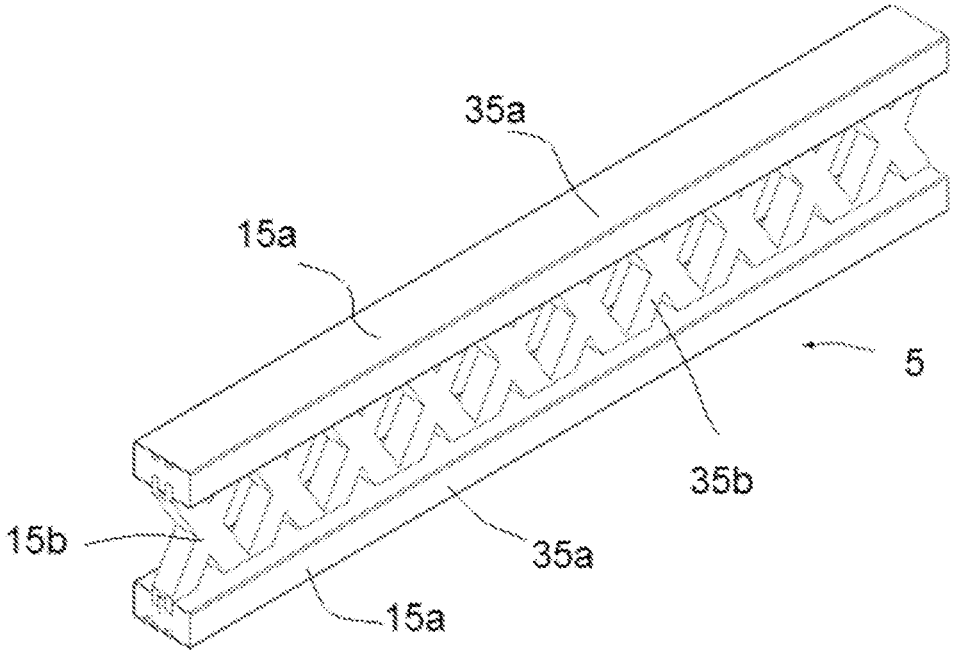
FIG. 5 shows a view in perspective of the formwork structural member shown in FIG. 4.

FIGS. 4 and 5 show another embodiment of a formwork structural member 5 according to the invention, wherein the web 15*b* is a truss web.

The web 15*b* of the formwork structural member 5, shown in detail in FIG. 4, comprises a first core 25*b* and a first casing 35*b* that covers the ends of the outer web 15*b* of the first core 25*b*. Each flange 15*a* of the formwork structural member 5 comprises a respective second core 25*a*, and a second casing 35*a* that covers the outer web of the second core 25*a*. The first core 25*b* comprises in each end projections 26 that cooperate with respective grooves 36 comprised in each second core 25*a*. Each second casing 35*a* also includes longitudinal openings 39, aligned respectively with the respective grooves 36 of the second core 25*a*, the projections 26 of the first core 25*b* passing through the respective openings 39 to be inserted in the respective grooves 36 of the second core 25*a*, the web 15*b* being fixed as a result to the corresponding flange 15*a*.

Figure 3:
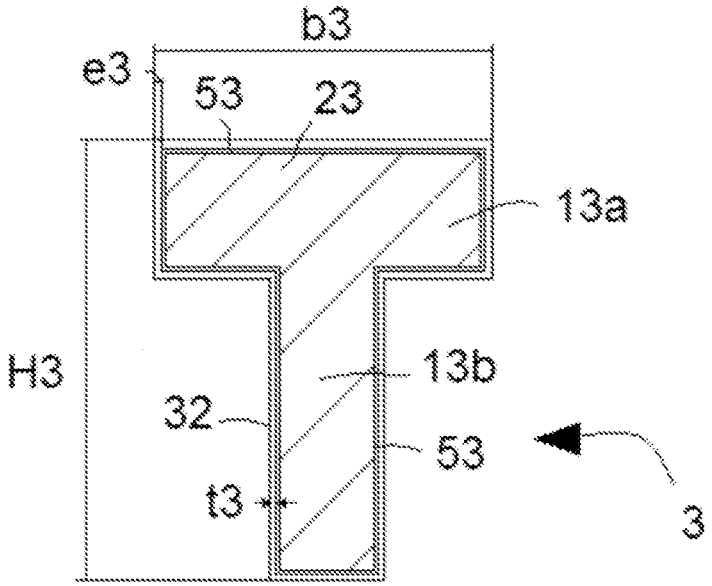
FIG. 3 shows a cross-section of a third embodiment of a formwork structural member.

In addition, in other embodiments the formwork structural member may have a cross-section different to the section of an I or double T shape. FIG. 3 thus shows another embodiment of the formwork structural member 3 according to the invention, wherein the formwork structural member 3 has a section substantially of a T shape. The formwork structural member 3 comprises a web 13*b* and a flange 13*a* that is arranged in one end of the web 13*b*. The formwork structural member 3 comprises a core 23 that extends continuously in the flange 13*a* and the web 13*b*, and a metal casing 33 that covers the free outer contour of the core 23, the casing 33 being of a cross-section substantially of a T shape. Both the web 13*b* and the flange 13*a* are solid.

Additionally, the core 21;22*a*,22*b*;23; 25*a*,25*b* of the formwork structural member 1;2;3; 5 shown in FIGS. 1 to 5 is made of a material that has a density between approximately 40 kg/m$^3$ and approximately 500 kg/m$^3$. The material of the core 21;22*a*,22*b*;23; 25*a*,25*b* is a plastic material. In the embodiments in which a material with a density between approximately 40 kg/m$^3$ and approximately 200 kg/m$^3$ is used, said material also comprises reinforcement means by means of which the impact-response properties and the response to the compression of the formwork structural member 1;2;3; 5 are improved. The reinforcement means may comprise fibreglass, aramid fibres, cellulose of paper, cardboard, nylon fibres, steel mesh and/or plastic profiles. Each of the aforementioned reinforcement means has a low weight and is cheap. Said reinforcement means can be inserted or embedded in the core 21;22*a*,22*b*;23; 25*a*,25*b* or instead can be arranged along the exterior of said core 21;22*a*,22*b*;23; 25*a*,25*b*.

In the second embodiment, shown in FIG. 2, the material of the first core 22*b* of the web 12*b* and of the second cores 22*a* of the respective flange 12*a* has a density between approximately 40 kg/m$^3$ and approximately 200 kg/m$^3$, each flange 12*a* including reinforcement means that make the formwork structural member 2 rigid. In this second embodiment, reinforcement is provided by the extensions 32*c* of the first casing 32*b* into the corresponding flange 12*a*, said extensions 32*c* being arranged between the second cores 22*a* of the flange 12*a*.

In the embodiments in which the core 21;23;25*a*,25*b* is made of a material with a density between approximately 200 kg/m$^3$ and approximately 500 kg/m$^3$ the reinforcement means are not necessary.

In the embodiments shown in FIGS. 1 to 5, the core 21;22*a*, 22*b*;23; 25*a*,25*b* has been formed separately, outside the casing 31;32*a*,32*b*;33; 35*a*,35*b*. In this case, the formed core 21;22*a*,22*b*;23; 25*a*,25*b* has a similar shape to the casing 31;32*a*,32*b*;33; 35*a*,35*b*, with dimensions that are such that when the core 21;22*a*,22*b*;23; 25*a*,25*b* is housed in the interior of the casing 31;32*a*,32*b*;33; 35*a*,35*b*, between said core 21;22*a*,22*b*;23; 25*a*,25*b* and the casing 31;32*a*,32*b*;33; 35*a*, 35*b*, there is a homogeneous space along the outer web of the core 21;22*a*,22*b*;23; 25*a*,25*b* of between approximately 1 mm and approximately 3 mm. The formwork structural member 1;2;3; 5 also comprises an adhesive means 51;52;53; 55 adapted to fix the metal casing 31;32*a*,32*b*;33; 35*a*,35*b* to the respective core 21;22*a*,22*b*,22*c*;23; 25*a*,25*b*. The core 21;22*a*,22*b*;23; 25*a*,25*b* is made of polyurethane, polyethylene or polystyrene, and the adhesive means 51;52;53; 55 is injected between the space between the metal casing 31;32*a*, 32*b*;33; 35*a*,35*b* and the respective core 21;22*a*,22*b*;23; 25*a*, 25*b*. The adhesive means 51;52;53; 55 comprises polyurethane, polyester or epoxy.

In other embodiments not shown in the figures the core 21;22*a*,22*b*;23; 25*a*,25*b* may be formed in the interior of the corresponding casing 31;32*a*,32*b*;33;35*a*,35*b*, substantially adopting a geometrical shape similar to the cross-section of the corresponding casing 31;32*a*,32*b*;33; 35*a*,35*b*. The core 21;22*a*,22*b*;23; 25*a*,25*b* that is injected in the interior of the casing 31;32*a*,32*b*; 3335*a*,35*b* is made of a material that has adhesive properties, with the result that when the core 21;22*a*, 22*b*;23; 25*a*,25*b* is injected in the interior of the casing 31;32, 33*a*,33*b*; 35*a*,35*b* it adheres to said metal casing 31;32*a*,32*b*;

33; 35*a*,35*b*. In these cases the core 21;22*a*,22*b*;23;25*a*,25*b* is made of a plastic material that comprises polyurethane.

In the embodiments shown in the figures, the metal casing 31;32*a*,32*b*;33; 35*a*,35*b* is made of steel, preferably cold-formed. The casing 31;32*a*,32*b*;33; 35*a*,35*b* has a thickness e1,t1;e2,t2;e3,t3;e5,t5 between approximately 0.5 mm and approximately 1 mm. In particular, in some embodiments, in the formwork structural members 1;2;5 with a section substantially of an I or double T shape, the second casing 31;32*a*; 35*a*, in other words the casing of the respective flange 11*a*; 12*a*;15*a*, has a thickness e1;e2;e5 of approximately 0.8 mm, and the first casing 31;32*b*;35*b*, in other words the casing that covers the web 11*b*;12*b*;15*b*, has a thickness t1;t2;t5 of approximately 0.5 mm. In other embodiments, the second casing 31;32*a*;35*a*, and the first casing 31;32*b*;35*b* have a thickness e1;e2;e5 of approximately 0.75 mm.

In other embodiments, the metal casing 31;32*a*,32*b*;33; 35*a*,35*b* may be made of a steel that has been pre-treated, for example lacquered, galvanised, phosphated or treated to allow adhesion to the corresponding core etc. to be improved through mechanical fastening.

In other embodiments not shown in the figures, for the purpose of improving the properties of the formwork structural member when it receives impacts, each formwork structural member may include in each end a protective member that covers both the web and the flanges, the protective member being made of an impact-resistant material.

In other embodiments not shown in the figures, for the purpose of improving the response of the formwork structural member to receiving impacts, the outside of the metal casing is covered with a layer of plastic, preferably polyurethane, of a thickness between approximately 0.5 mm and approximately, 3 mm. As well as protecting the formwork structural member when it receives impacts, the layer of polyurethane protects it from high temperatures. It also allows the formwork structural members to be easily identified from each other, as a layer of coloured polyurethane is applied on the metal casing.

The invention claimed is:

1. A formwork structural member comprising a web and a first flange located at a first end of the web, each of the web and first flange having a core made of a material that has a density between 40 kg/m$^3$ and 500 kg/m$^3$, and at least one metal casing that is attached to and substantially covers an outer contour of the core of the web and flange, wherein the at least one metal casing is attached to the core by an adhesive, the adhesive being selected from the group consisting of polyurethane, polyester and epoxy.

2. A formwork structural member according to claim 1, wherein the core of the web and flange comprises a plastic material.

3. A formwork structural member according to claim 2, wherein the plastic material is selected from the group consisting of polyurethane, polyethylene and polystyrene.

4. A formwork structural member according to claim 1, wherein the at least one metal casing is made of steel and has a thickness between 0.5 mm and 1.0 mm.

5. A formwork structural member according to claim 1, wherein the adhesive resides in a space between the core and the at least one metal casing.

6. A formwork structural member according to claim 1, wherein the core comprises a material having an adhesive property that facilitates the attachment of the core to the metal casing.

7. A formwork structural member according to claim 1, wherein the core comprises a plastic material that has a density of between 200 kg/m$^3$ and 500 kg/m$^3$.

8. A formwork structural member according to claim 1, wherein the core comprises a plastic material having a density of between 40 kg/m$^3$ and 200 kg/m$^3$ and further comprises within the plastic material a reinforcement material that improves the impact and compression response of the formwork structural member in comparison to the plastic material being devoid of the reinforcement material.

9. A formwork structural member according to claim 8, wherein the reinforcement material is selected from the group consisting of fibreglass, aramid fibres, cellulose of paper, cardboard, nylon fibres, steel mesh and plastic profiles.

10. A formwork structural member according to claim 1, comprising a second flange attached to a second end of the web and arranged substantially parallel to the first flange, each of the web, first flange and second flange having the core made of a material that has a density between 40 kg/m$^3$ and 500 kg/m$^3$.

11. A formwork structural member comprising a web having a first end, a second end opposite the first end and a first flange assembly coupled to the first end, the web comprising a first core, the first flange comprising a second core located on a first side of the web and a third core located on a second side of the web opposite the first side, the formwork structural member including first and second metal casings, the first metal casing being attached to the first core and extending along at least a portion of the height of the web between the first and second ends to cover at least a portion of an outer contour of the first core, the second metal casing being attached to the first end of the web and to the second and third cores so as to cover at least a portion of an outer contour of the second and third cores, the first metal casing extending to the first end of the web.

12. A formwork structural member according to claim 11, wherein the second and third cores comprise a plastic material that has a density between 40 kg/m$^3$ and 200 kg/m$^3$.

13. A formwork structural member according to claim 11, wherein the first and second metal casings are coupled to one another.

14. A formwork structural member according to claim 13, wherein the first metal casing includes a first notch on the first side of the web and a second notch on the second side of the web, and the second metal casing comprises a first end and a second end opposite the first end, each of the first and second ends of the second metal casing residing in the first and second notches of the first metal casing, respectively.

15. A formwork structural member comprising a web and a first flange located at a first end of the web, each of the web and first flange having a core made of a plastic material that has a density between 40 kg/m$^3$ and 200 kg/m$^3$, and at least one metal casing that is attached to and substantially covers an outer contour of the core of the web and flange, the formwork structural member further comprises within the plastic material a reinforcement material that improves the impact and compression response of the formwork structural member in comparison to the plastic material being devoid of the reinforcement material, the reinforcement material being selected from the group consisting of fibreglass, aramid fibres, cellulose of paper, cardboard, nylon fibres, steel mesh and plastic profiles.

16. A formwork structural member comprising a web having a first end, a second end opposite the first end and a first flange assembly coupled to the first end, the web comprising a first core, the first flange comprising a second core located on a first side of the web and a third core located on a second side of the web opposite the first side, the formwork structural member including first and second metal casings, the first metal casing being attached to the first core and extending along at least a portion of the height of the web between the first and second ends to cover at least a portion of an outer contour of the first core, the second metal casing being attached to the first end of the web and to the second and third cores so as to cover at least a portion of an outer contour of the second and third cores, the first and second metal casings being coupled to one another, the first metal casing including a first notch on the first side of the web and a second notch on the second side of the web, and the second metal casing comprising a first end and a second end opposite the first end, each of the first and second ends of the second metal casing residing in the first and second notches of the first metal casing, respectively.

* * * * *